US006585880B1

(12) United States Patent
Watanabe et al.

(10) Patent No.: US 6,585,880 B1
(45) Date of Patent: Jul. 1, 2003

(54) METHOD FOR RECOVERING CHEMICALS IN A PROCESS OF PRODUCING PULP BY KRAFT PROCESS

(75) Inventors: Keigo Watanabe, Yamaguchi (JP); Yasunori Nanri, Yamaguchi (JP); Kazuaki Sakai, Kanagawa (JP); Tatsuya Andoh, Kanagawa (JP); Makoto Nakao, Tokyo (JP)

(73) Assignees: Nippon Paper Industries Co., Ltd., Tokyo (JP); Kawasaki Kasei Chemicals Ltd., Tokyo (JP)

( * ) Notice: Subject to any disclaimer, the term of this patent is extended or adjusted under 35 U.S.C. 154(b) by 0 days.

(21) Appl. No.: 09/926,643

(22) PCT Filed: May 26, 2000

(86) PCT No.: PCT/JP00/03401

§ 371 (c)(1),
(2), (4) Date: Nov. 28, 2001

(87) PCT Pub. No.: WO00/73578

PCT Pub. Date: Dec. 7, 2000

(30) Foreign Application Priority Data

May 28, 1999 (JP) ..... 11-150354

(51) Int. Cl.[7] ..... C02F 1/461
(52) U.S. Cl. ..... 205/494; 205/554; 205/746
(58) Field of Search ..... 205/494, 554, 205/746

(56) References Cited

U.S. PATENT DOCUMENTS

| | | | | |
|---|---|---|---|---|
| 5,624,545 A | * | 4/1997 | Landfors et al. | 205/746 |
| 5,972,197 A | | 10/1999 | Andoh et al. | |
| 6,264,819 B1 | | 7/2001 | Andoh et al. | |

FOREIGN PATENT DOCUMENTS

| | | |
|---|---|---|
| JP | 8-311790 | 11/1996 |
| SE | 7506965 | 12/1976 |
| SE | 501 204 | 12/1994 |
| WO | WO 94/12720 | 6/1994 |
| WO | WO 97/41295 | 11/1997 |

* cited by examiner

*Primary Examiner*—Arun S. Phasge
(74) *Attorney, Agent, or Firm*—Oblon, Spivak, McClelland, Maier & Neustadt, P.C.

(57) ABSTRACT

In a process for producing kraft pulp, the process is made closed, the yield of pulp is improved and environmental problems are minimized. An alkaline solution containing $Na_2S$ which flows in a process of producing kraft pulp, is electrolyzed by an electrolytic oxidation method; a liquid which is formed at an anode side and contains a polysulfide type sulfur in an amount of 6 g/l or more, is added, as it is or after being causticized, to the process before a chip has the maximum temperature, and a NaOH solution formed at a cathode side, is added to at least one step of the process after the chip has the maximum temperature till a final bleaching stage; and at least chemicals in the step wherein NaOH is added, among chemicals discharged in all steps from a cooking step till the final bleaching stage, are recovered and reused.

10 Claims, 3 Drawing Sheets

EMBODIMENT FOR ELECTROLYZING THE WHOLE OF WHITE LIQUOR

EMBODIMENT FOR ELECTROLYZING THE WHOLE OF WHITE LIQUOR

EMBODIMENT FOR ELECTROLYZING A PART OF GREEN LIQUOR

METHOD FOR RECOVERING CHEMICALS IN A PROCESS OF PRODUCING PULP BY KRAFT PROCESS

TECHNICAL FIELD

The present invention relates to a method for recovering chemicals in a process of producing kraft pulp, wherein chemical solutions i.e. a catholyte and an anolyte, obtained by electrolyzing white liquor or green liquor i.e. an alkaline solution containing $Na_2S$ in an electrolytic cell, are efficiently utilized in a cooking step and a bleaching step in the process for producing kraft pulp, and chemicals in a liquid discharged after such utilization, are recovered, regenerated and reused.

BACKGROUND ART

Heretofore, as an alkali source for the oxygen delignification step in a process for producing kraft pulp, oxidized white liquor obtained by oxidizing an atomic group containing sulfur in white liquor with air in the presence of a catalyst to thiosulfuric acid, has been employed. Here, it is possible to carry out oxygen bleaching by using sodium hydroxide brought in from outside of the system. However, this means that the reagent to be used is brought in from outside of the system, and such is problematic in an attempt to proceed with a closed system of the process for producing kraft pulp. Further, the effluent from the oxygen delignification step is usually recovered by a recovery boiler, and such bringing in of sodium hydroxide tends to destroy the balance in the chemical recovery system. In order not to destroy the balance of the chemical recovery system, an alkali source derived from white liquor such as oxidized white liquor, will be required.

Besides, the above air oxidation method oxidizes sodium sulfide ($Na_2S$) as an alkali source in white liquor to a level of sodium thiosulfate ($Na_2S_2O_3$), and accordingly, the alkali source as active alkali will be made ineffective and wasted (lost). Further, in order to proceed with a closed system of the process for producing kraft pulp, also the effluent from a bleaching step subsequent to the oxygen delignification step, will be recovered by a recovery boiler, and if oxidized white liquor is to be used as a recoverable alkali source to be supplied to such a step, the required amount of white liquor correspondingly increases, and the load of the recovery boiler will correspondingly increase, such being a drawback.

Further, with respect to a method for forming a polysulfide, various methods are known, such as a method of oxidation with air in the presence of activated carbon catalyst (JP-A-47-10217), a method of oxidation with air in the presence of a lime sludge and a catalyst (JP-A-8-209573, JP-A-9-87987), a method of direct oxidation by means of an oxidation-reduction resin (JP-A-56-149304), a method of dissolving sulfur (JP-A-8-311790, JP-A-54-151602), and a method of directly forming it by electrolysis (JP-A-8-512099=PCT International Publication WO95/0071). However, one industrially practically used for the purpose of producing pulp at present, is only the air oxidation method employing the activated carbon catalyst (JP-A-47-10212, JP-A-53-92981).

However, by the air oxidation method employing the activated carbon catalyst, sodium sulfide having an effective cooking effect in the cooking step will be consumed by the oxidation to cooking-inactive sodium thiosulfate. Taking the balance of the entire white liquor into consideration, this means nullification i.e. a serious loss by the oxidation of effective sodium sulfide, and yet, an expensive oxidation installation is required for the oxidation of white liquor. Thus, the conventional process for producing kraft pulp has many drawbacks.

Further, in order to recover and reuse chemicals in the bleach effluent, the recovery boiler is required to have a reserve capacity. Loads on the recovery boiler include a load relating to organic substances and a load relating to inorganic substances, and the former can be reduced by an improvement in the yield of pulp, and the latter can be reduced by cutting back on the base unit of chemicals. Thus, a reserve capacity may be had by changing the installation or by reducing the production. However, in view of a problem in the efficiency or a problem in the cost, it is desired to rely on other methods.

As a method of improving the yield to reduce the load by organic substances i.e. the organic solid content, a polysulfide (PS) cooking method is known, and as a method for cutting back chemicals to reduce the load by inorganic substances i.e. the inorganic solid content, an AQ type assistant addition method is, for example, known. Further, as disclosed in JP-A-5-163690, JP-A-10-506687 and JP-A-10-53989, it is known to carry out better cooking by increasing the $Na_2S$ concentration at the initial stage of cooking and by controlling so that the active alkali concentration will not become lower than a certain level until completion of the cooking. Also by such a method, it is possible to reduce the load on the boiler, but by this method, it is necessary to add chemical solutions having a plurality of $Na_2S$ concentration compositions dividedly to the digester.

To form chemical solutions having a plurality of $Na_2S$ concentration compositions, it is necessary to rely on a method such as a method for thermally decomposing black liquor (JP-A-8-311790), a method for crystallizing green liquor wherein sodium carbonate is precipitated by changing the temperature or the concentration, or a method for dialyzing white liquor wherein sodium sulfide content is concentrated by electric dialysis (Journal Of Pulp and Paper Science, Vol. 23, No. 4, p.182–187, April, 1997). However, when it is attempted to combine such a method with a polysulfide cooking method, at least two steps will be required, whereby the process tends to be complex.

In addition to such various problems, a large amount of drainage is discharged in the conventional process for producing kraft pulp. From the viewpoint of the problem of environmental pollution, it is desired to minimize the amount of such drainage, even though it can not be reduced to zero. Further, heretofore, a chlorine-type bleaching agent has been used in a step of bleaching pulp obtained via a step of washing with water and a blow tank after the cooking step, but the chlorine-type substance has a problem of environmental pollution.

It is an object of the present invention to solve the various drawbacks in the conventional process for producing kraft pulp, such that (1) a material balance will be destroyed if an alkali source from outside of the system, is employed, (2) if oxidized white liquor is used, the alkali source as active alkali will be wasted, and (3) the load on the boiler increases as the range for recovery of the bleach effluent expands, and to provide a method for recovering chemicals, whereby the process for producing kraft pulp will be made to be a closed system, the yield of pulp is improved, and yet, an environmental problem is minimized.

Namely, it is an object of the present invention to solve the various problems in the above items (1) to (3) in the conventional method and to provide a method for recovering chemicals, wherein chemicals discharged from the process are efficiently reproduced and utilized in the process for producing kraft pulp, and the process is made to be a closed system whereby drainage will be made minimum or will not be discharged out of the system, whereby the process for producing kraft pulp is made efficient, and the environmental problem is solved at the same time.

Further, it is an object of the present invention to solve the various problems of the above items (1) to (3) in the conventional method and to provide a method for recovering chemicals, whereby chemicals discharged from the process are efficiently reproduced and reused without using or by minimizing a chlorine-type bleaching agent such as NaClO, $ClO_2$ or $Cl_2$ in the process for producing kraft pulp, and the process is made to be closed so that drainage will not be discharged out of the system or will be minimized, the process for producing kraft pulp is made efficient, and environmental problems will be solved at the same time.

DISCLOSURE OF THE INVENTION

The present invention is a method for recovering chemicals in a process of producing kraft pulp, characterized in that an alkaline solution containing $Na_2S$ which flows in a process of producing kraft pulp, is electrolyzed by an electrolytic oxidation method; a liquid containing a polysulfide type sulfur, which is formed at an anode side, in an amount of 6 g/l or more, is added, as it is or after being causticized, to the process before a chip has the maximum temperature, and a NaOH solution formed at a cathode side, is added to at least one step of the process after the chip has the maximum temperature till a final bleaching stage; and at least chemicals in the step wherein NaOH is added, among chemicals discharged in all steps from a cooking step till the final bleaching stage, are recovered and reused.

In the present invention, new techniques relating to kraft cooking in a process for producing kraft pulp are combined in a most suitable form, whereby chemicals discharged in the process for producing kraft pulp are efficiently reproduced, recovered and reused, and the process is closed so that chemicals will not be brought in from outside of the system, and drainage will not be discharged out of the system or minimized as far as possible.

Namely, in the present invention, with respect to the balance of material amounts in the process for producing kraft pulp, it has been found that by using an electrolytic oxidation method (which will be referred to optionally as an electrolytic method in this specification), it is possible to obtain a reserve capacity for recovery of the effluent for the recovery boiler and to form recoverable NaOH simultaneously and efficiently, and such a discovery is effectively utilized for a closed system of the process for producing kraft pulp, whereby the closed system for the process for producing kraft pulp can easily be accomplished. Further, in the present invention, a chlorine-type bleaching agent is not employed or is minimized as far as possible, whereby in addition to the above effect, it is possible to solve a problem of an environmental pollution resulting in a case where a chlorine-type bleaching agent is employed.

The present invention is constituted by combining (1) a polysulfide cooking method which is a technique to improve the yield of pulp, (2) a two stage sulfidity cooking method which is a technique corresponding to adding a chemical solution in multistages, and (3) an electrolytic method which is a technique for forming a polysulfide highly efficiently. Further, in the present invention, (4) a quinones-addition cooking method is combined therewith to obtain a further effective effect.

BEST MODE FOR CARRYING OUT THE INVENTION

Figure 1:
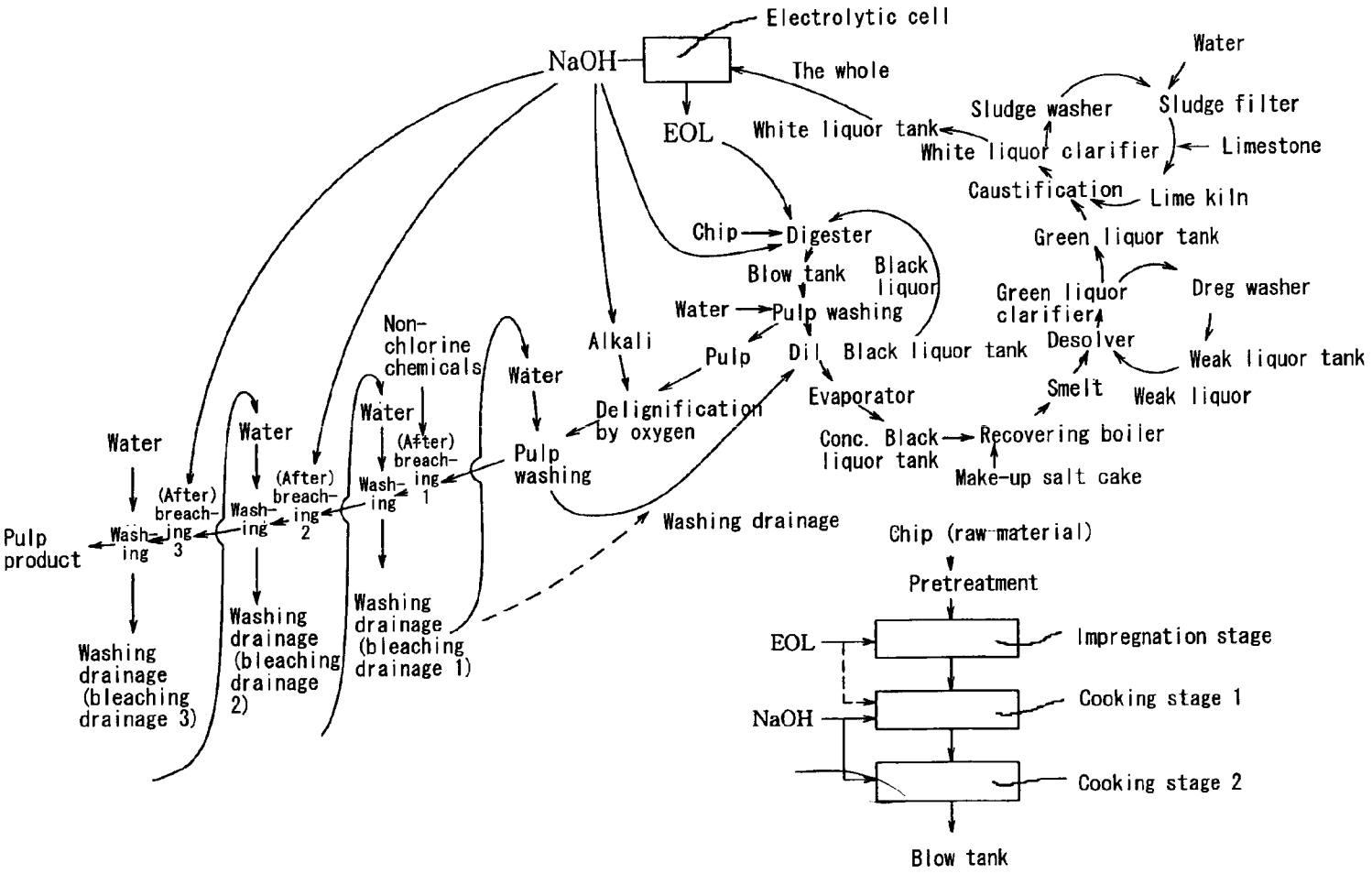
FIG. 1 is a diagram illustrating an embodiment of the process for producing kraft pulp of the present invention.
Figure 2:
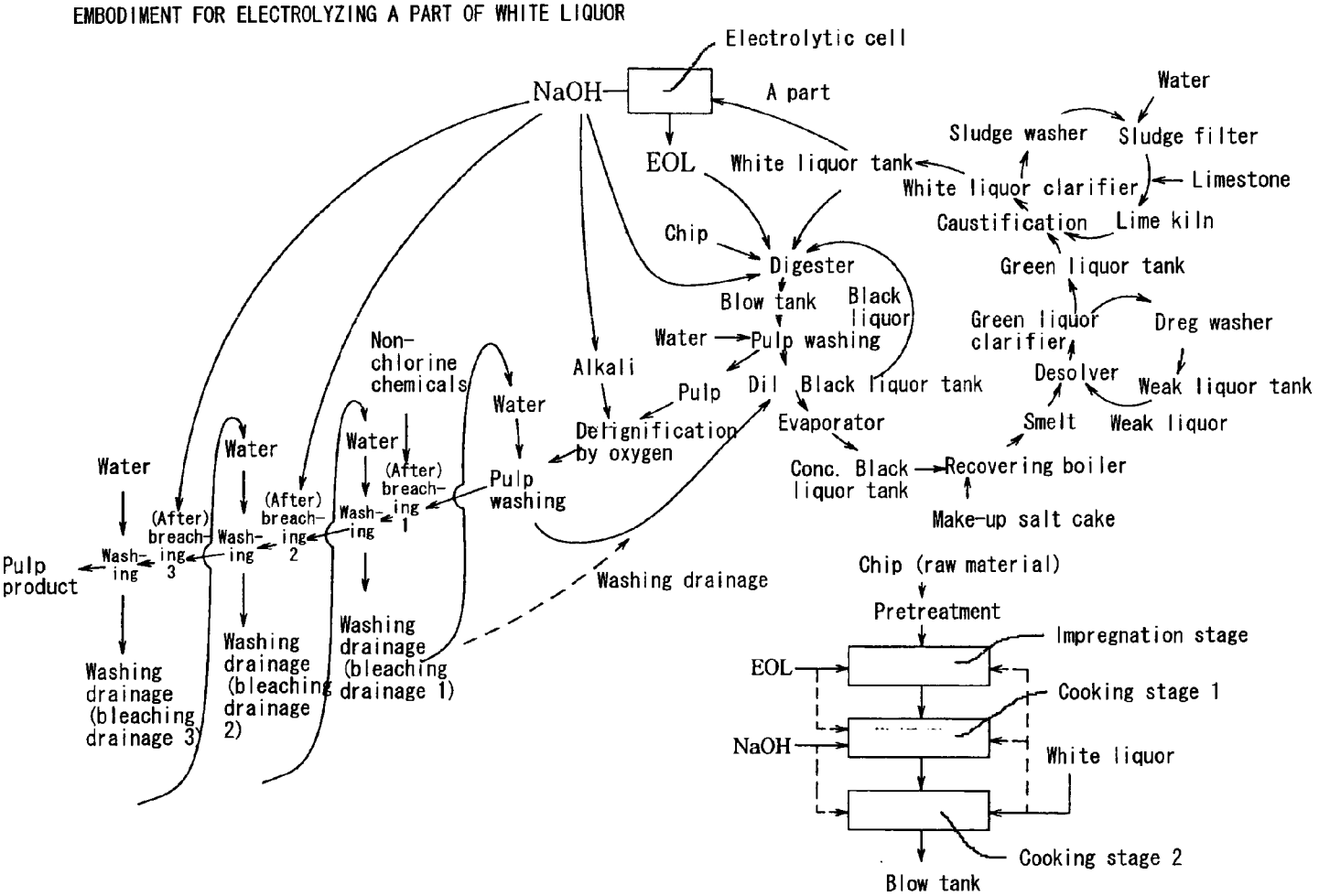
FIG. 2 is a diagram illustrating an embodiment of the process for producing kraft pulp of the present invention.
Figure 3:
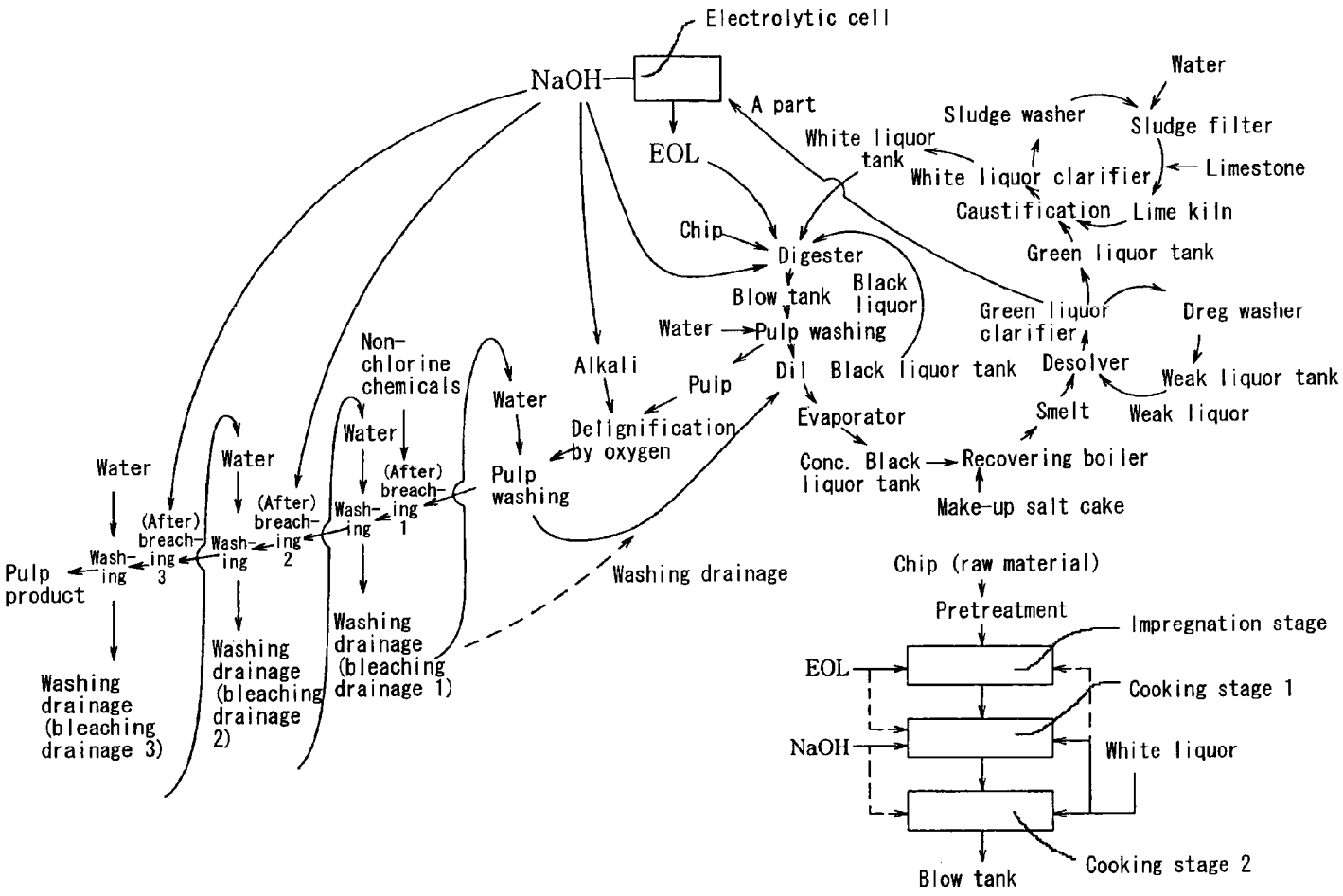
FIG. 3 is a diagram illustrating an embodiment of the process for producing kraft pulp of the present invention.

FIGS. 1 to 3 are diagrams illustrating the process for producing kraft pulp wherein the polysulfide cooking method of the above (1) is applied, and (2) to (3) are used in combination therewith in the present invention. FIG. 1 is an embodiment wherein the whole of white liquor is electrolyzed, FIG. 2 is an embodiment wherein a part of white liquor is electrolyzed, and FIG. 3 is an embodiment wherein a part of green liquor is electrolyzed. Further, in FIGS. 1 to 3, "EOL (Electrolytic Orange Liquor)" means a solution having a polysulfide formed by an electrolytic oxidation method from an alkaline solution containing $Na_2S$, such as white liquor or green liquor.

In FIGS. 1 to 3, the process shown in a circular form at the right upper portion, is a conventional process as a prerequisite of the present invention. In the present invention, the above-mentioned (1) to (3) are combined thereto. In FIGS. 1 to 3, the portion identified as a digester is a portion corresponding to the cooking step. In the present invention, as shown at the light lower portion in FIGS. 1 to 3, a two stage sulfidity cooking method is applied as the cooking step.

This cooking step is constituted by an impregnation stage, a cooking stage 1 and a cooking stage 2 in a digester. The impregnation stage is constituted from a point where a chip will join to at least a part of a cooking liquor used for cooking i.e. a joining position of the two, to a first circulation after the temperature of the chemical solution exceeds about 140° C. and before the chip has the maximum temperature. The cooking stage 1 is constituted from the first circulation after the temperature of the chemical solution exceeds about 140° C. to a position of a main extraction strainer wherein at least about 50% of black liquor extracted from the digester, is extracted.

The cooking stage 2 is constituted from the position of the main extraction strainer wherein at a level of 50% or higher of black liquor extracted from the digester, is extracted, to a circulation immediately thereafter. To the cooking stages 1 and 2, an alkali source is supplied, and with respect to the cooking stage 2, the alkali source is supplied from the circulation at the lowest part of the digester. In a case where the circulations immediately after the main extraction strainer and thereafter are also employed for the cooking reaction, from the circulation immediately after the main extraction strainer to the circulation at the lowest part of the digester, will be included.

The chip (the raw material) is sent to a chemical impregnation stage usually via a pretreatment step. In the present invention, the above-mentioned two stage sulfidity cooking method (2) comprising the cooking stage 1 and the cooking stage 2, following the impregnation stage, is applied, and the polysulfide liquor obtained by the above-mentioned electrolytic method (3) i.e. the polysulfide liquor (EOL) obtained in the "electrolytic cell" in FIGS. 1 to 3, is supplied before the chip has the maximum temperature i.e. to the impregnation stage, and the solution containing as the main component NaOH obtained by the above electrolytic method (3) is supplied to the cooking stage 1, the cooking stage 2, an oxygen delignification stage, a post bleaching 2 and a post bleaching 3. A part of EOL from the electrolytic cell may be supplied to the cooking stage 1. In the embodiment wherein a part of white liquor is electrolyzed, as in FIG. 2, the rest of white liquor is supplied to the cooking stage 2, but a part thereof may be supplied to one or both of the impregnation stage or the cooking stage 2. In the embodiment wherein a part of green liquor is electrolyzed, as in FIG. 3, white liquor is supplied to the cooking stage 1 and the cooking stage 2, but a part thereof may be supplied to the impregnation stage.

The polysulfide cooking method (1) is a method to improve the yield of pulp. However, the polysulfide is unstable at a high temperature (at a level of 120° C. or higher). Accordingly, by cooking wherein a chemical solution is dividedly added to a high temperature site, the effect tends to be small in correspondence with the proportion of addition to the high temperature site, even though a substantial effect for improving the yield can be obtained by high concentration of the polysulfide sulfur. The polysulfide cooking is capable of reducing the load to the boiler due to organic substances by the improvement of the yield, but it is not suitable for the technique of adding a chemical solution dividedly.

In a cooking step, an ideal cooking is such that high sulfidity is maintained at the initial stage, and a constant alkali concentration is maintained till the completion of cooking. The two stage sulfidity cooking method (2) to be used in the present invention is a method for realizing this. When a product having the same Kappa number is produced, improvement of the yield, and saving of chemicals for cooking can be expected, and a still further large effect for improving the yield can be expected by forming a polysulfide from white liquor having a high sulfidity for addition at the initial stage. In the present invention, the above-mentioned excellent effects can be obtained by a single step of applying the above-mentioned electrolytic method (3) for the formation of a polysulfide from white liquor. Whereas, if the above-mentioned green liquor crystallizing method or the black liquor thermal decomposition method is employed as a method for obtaining chemical solutions having two types of sulfidity compositions from a single chemical recovery system, it will be required to use a separate step for forming a polysulfide, whereby the process tends to be complex.

When the polysulfide is formed by a conventional oxidation method by air (such as the following reaction formula 1), a side reaction takes place (such as the following reaction formula 2 or 3) wherein a part of the polysulfide is converted to sodium thiosulfate due to oxidation of the polysulfide by air. Therefore, the oxidation method by air is poor in the efficiency for converting $Na_2S$ in white liquor to a polysulfide. Further, this side reaction tends to take place more readily if it is attempted to increase the concentration of the polysulfide type sulfur. Therefore, by such an oxidation method by air, only an increase of the concentration of the polysulfide type sulfur corresponding to an increase of the $Na_2S$ concentration can be expected.

$$4Na_2S+O_2+2H_2O \rightarrow 2Na_2S_2+4NaOH \quad (1)$$

$$2Na_2S+2O_2+2H_2O \rightarrow Na_2S_2O_3+2NaOH \quad (2)$$

$$2Na_2S+3O_2 \rightarrow Na_2S_2O_3 \quad (3)$$

Therefore, the alkaline cooking liquor containing a polysulfide of the present invention, is formed by a method of electrochemically oxidizing sulfide ions in an alkaline cooking liquor containing sodium hydroxide and sodium sulfide as the main components, such as white liquor, i.e. by an electrolytic method (3). The electrolytic method to be used in the present invention is not particularly limited, but preferably, the following electrolytic methods can be applied [(A) JP-10-166374, (B) JP-11-51016, (C) JP-11-51033]. These methods are previously developed by the present inventors. With respect to an electrolytic method, studies and researches were conducted with respect to the construction of the anode, the conditions for disposition of the anode in an anode compartment, the pressure conditions in the cathode and anode compartments and other various requirements, and important requirements for obtaining effective effects, such as minimizing a side reaction to produce thiosulfate ions, were discovered, and the method was constructed on the basis of such a discovery.

Here, polysulfide type sulfur may be referred to also as polysulfide sulfur (PS-S), and it is meant for sulfur of 0 valency in e.g. sodium polysulfide $Na_2S_x$, i.e. sulfur of (x−1) atoms. Further, in the present specification, sulfur corresponding to sulfur having oxidation number of −2 in the polysulfide ions (sulfur of one atom per $S_x^{2-}$) and sulfide ions ($S^{2-}$) will generally be referred to as $Na_2S$-state sulfur. From this viewpoint, the polysulfide means a combination of polysulfide sulfur and $Na_2S$-state sulfur, and the $Na_2S$-state sulfur means sulfur of $Na_2S$ among sodium sulfide ($Na_2S$) and $Na_2S_x$.

The technique of (A) JP-10-166374 is a method for producing polysulfides, characterized by obtaining polysulfide ions by electrolytic oxidation by introducing a solution containing sulfide ions into an anode compartment of an electrolytic cell comprising the anode compartment provided with a porous anode, a cathode compartment provided with a cathode, and a diaphragm partitioning the anode compartment and the cathode compartment, wherein at least the surface of the anode is made of nickel or a nickel alloy containing at least 50 wt % of nickel, and the anode has a physically continuous three dimensional network structure, and the surface area of the anode per unit volume of the anode compartment is from 500 to 20,000 $m^2/m^3$. By this method, a cooking liquor containing polysulfide type sulfur at a high concentration can be produced while maintaining high selectivity, whereby by-production of thiosulfate ions is very small, and the yield of pulp can effectively be increased by using the polysulfide cooking liquor thus obtained for cooking. Further, the anode has a physically continuous network structure as is different from an aggregate of fibers, whereby the cell voltage can be made lower, and the operation cost can be suppressed to a low level. Further, the anode to be used for this technique has excellent electric conductivity, whereby the porosity of the anode can be made large, whereby the pressure loss can be reduced.

The technique of (B) JP-11-51016 is a method for producing polysulfides to obtain polysulfide ions by electrolytic oxidation by introducing a solution containing sulfide ions into an anode compartment of an electrolytic cell comprising the anode compartment provided with a porous anode, a cathode compartment provided with a cathode, and a diaphragm partitioning the anode compartment and the cathode compartment, characterized in that the pressure in the cathode compartment is higher than the pressure in the anode compartment. By this method, a cooking liquor containing polysulfide type sulfur at a high concentration and having a large amount of residual $Na_2S$-state sulfur, can be produced with a low electric power while maintaining high selectivity, with little by-production of thiosulfate ions, and the yield of pulp can effectively be increased especially when a polysulfide cooking liquor thus obtained from white liquor or green liquor from the process for producing pulp, is used for cooking.

By this technique, the electrolytic operation is carried out under a condition such that the pressure in the cathode compartment is higher than the pressure in the anode compartment. The electrolytic cell usually has a structure in which a diaphragm is sandwiched between an anode and a cathode. From the viewpoint of the precision in assembling or the protection of the diaphragm, the anode and the cathode are disposed with a relatively large distance inbetween. Specifically, they are distanced for about a few mm in many cases. The diaphragm disposed therebetween may approach to the anode side or to the cathode side depending upon the condition of electrolysis. In this technique, the diaphragm is set to be always in contact with the anode, so that no space is left between the anode and the diaphragm, and the anode liquid is all introduced into the interior of the porous anode thereby to improve the current efficiency, etc. As such a means, the electrolytic operation is carried out under such a condition that the pressure in the cathode compartment is higher than the pressure in the anode compartment. By such a construction, the diaphragm is pressed against the anode, and the anode liquid is permitted to flow sufficiently into the interior of the porous anode, whereby high selectivity can be realized.

In this technique, as a means to increase the pressure in the cathode compartment over the pressure of the anode compartment, a method of relatively increasing the flow rate of a solution (a cathode liquid) introduced into the cathode compartment over the flow rate of a solution to be introduced into the anode compartment, or a method of increasing the outlet resistance of the cathode liquid, for example, by reducing the outlet pipe diameter on the cathode side, may, for example, be mentioned.

The technique of (C) JP-11-51033 is a method for producing polysulfides, which comprises introducing a solution containing sulfide ions into an anode compartment of an electrolytic cell comprising the anode compartment provided with a porous anode, a cathode compartment provided with a cathode, and a diaphragm partitioning the anode compartment and the cathode compartment, for electrolytic oxidation to obtain polysulfide ions, characterized in that the porous anode is disposed so that a space is provided at least partly between the porous anode and the diaphragm, and the apparent volume of the porous anode is from 60% to 99% based on the volume of the anode compartment. By this method, by-production of thiosulfate ions is very little, and a cooking liquor containing a polysulfide type sulfur at a high concentration and having a large amount of the residual $Na_2S$-state sulfur, can be produced while maintaining high selectivity. By using the polysulfide cooking liquor thus obtained for cooking, the yield of pulp can effectively be increased. Further, the pressure loss during the electrolytic operation can be reduced, and clogging of SS (suspended substances) can be suppressed.

In this technique, the porous anode is disposed so that a space is provided at least partly between the porous anode and the diaphragm, and the apparent volume of the porous anode is from 60 to 99% based on the volume of the anode compartment. Here, the volume of the anode compartment is the volume of a space defined by the effective current-carrying surface of the diaphragm and an apparent surface of the portion of the stream of an anode solution most distanced from the diaphragm. The space to be formed between the anode and the diaphragm, may be formed over the entire effective current-carrying surface or may be formed at a part thereof. In a case where clogging is likely to take place when a solid component having a large particle size enters into the electrolytic cell, this space is preferably continuous as a flow path. If this apparent volume exceeds 99%, the pressure loss tends to be large on the electrolytic operation, or suspended substances are likely to cause clogging, such being undesirable. If the apparent volume is less than 60%, the amount of the anode solution flowing through the porous anode tends to be small, whereby the current efficiency tends to be poor, such being undesirable. Within this range, the electrolytic operation can be carried out with a small pressure loss without clogging while maintaining a good current efficiency. This value is more preferably set to be from 70 to 99%.

Further, in this technique, it has been found that a space on the diaphragm side will provide an unexpected effect. It is considered that the electrode reaction of the anode in this technique takes place substantially over the entire surface of the porous anode, but at a portion of the anode close to the diaphragm, the electric resistance of the solution is small, and the current tends to flow readily, whereby the reaction proceeds preferentially. Accordingly, at such a portion, the reaction tends to be mass transfer rate controlling, whereby by-products such as thiosulfate ions or oxygen, tend to form, or dissolution of the anode is likely to occur. However, if a space is provided between the porous anode and the diaphragm, the linear velocity of the anode solution through this space tends to be high, the flow rate of the solution at a portion on the diaphragm side of the anode increases as induced by this flow, and the material diffusion at the portion of the anode close to the diaphragm will be advantageous, whereby it is possible to effectively control the side reactions. Further, by this space, the flow of the anode solution tends to be smooth, and there will be a merit that deposition tends to scarcely accumulate on the anode side surface of the diaphragm.

These techniques (A) to (C) are suitable particularly for producing polysulfides and obtaining a NaOH solution by treating white liquor or green liquor in the process for producing pulp. In the present invention, they are utilized for introducing white liquor or green liquor into an anode compartment i.e. an anode side, of an electrolytic cell, and adding a polysulfide solution thereby formed, as it is or after being causticized, to the process before a chip has the maximum temperature. Further, they are utilized by adding a NaOH solution (containing also a small amount of KOH) formed in a cathode compartment i.e. at a cathode side, of the electrolytic cell, to at least one step of the process after the chip has the maximum temperature till a final bleaching stage.

With respect to these methods, the following description will be made mainly with reference to the technical content and various embodiments of (A), but the same applies also with respect to the techniques (B) to (C). An alkaline cooking liquor containing sodium hydroxide and sodium sulfide as the main components, is supplied continuously to an anode compartment of an electrolytic cell comprising the anode compartment provided with an anode, a cathode compartment provided with a cathode and a diaphragm partitioning the anode compartment and the cathode compartment.

In such a case, the anode material is not particularly limited so long as it is alkaline and has oxidation resistance, and a non-metal or a metal may be employed. As the non-metal, a carbon material may, for example, be used, and as the metal, a base metal such as nickel, cobalt or titanium, or an alloy thereof, a noble metal such as platinum, gold or rhodium, or an alloy or an oxide thereof, may be employed. As the structure of the anode, it is preferred to employ a porous anode having a physically three dimension network structure. Specifically, for example, in the case of a nickel anode material, a porous nickel may be mentioned, which is obtained by applying nickel plating on a skeleton of a foamed polymer material and then burning off the polymer material in the interior, may be mentioned.

In the case of the above porous anode having physically three dimensional network structure, the porous anode is disposed in an anode compartment, wherein at least the surface of the anode is made of nickel or nickel alloy containing at least 50 wt % of nickel, the anode has a physically continuous three dimensional network structure, and the surface area of the anode per unit volume of the anode compartment is from 500 to 20,000 $m^2/m^3$. Since at least the surface portion of the anode is made of nickel or a nickel alloy, it has a practically sufficient durability in the production of polysulfides. The anode surface is preferably nickel, but a nickel alloy containing at least 50 wt % of nickel, may also be used. One having a nickel content of at least 80 wt %, is more preferred. Nickel is relatively inexpensive, and its elusion potential or a potential to form an oxide is higher than the potential to form a polysulfide sulfur or thiosulfate ions. Accordingly, it is an electrode material suitable to obtain polysulfide ions by electrolytic oxidation.

Further, it is porous and has a three dimensional network structure, whereby it has a large surface area, and when it is used as an anode, the desired electrolytic reaction takes place over the entire surface of the electrode, and formation of by-products can be suppressed. Further, such an anode is of a physically continuous network structure, as is different from an aggregate of fibers, whereby it shows a sufficient electric conductivity as an anode, and the IR drop at the anode can be reduced, whereby the cell voltage can be made lower. Further, the anode has excellent electric conductivity, whereby the porosity of the anode can be made large, and the pressure loss can be minimized.

The surface area of the anode per unit volume of the anode compartment is required to be 500 to 20,000 $m^2/m^3$. Here, the volume of the anode compartment is the volume of the portion defined by the effective current-carrying area of the diaphragm and the current collector plate of the anode. If the surface area of the anode is smaller than 500 $m^2/m^3$, the current density at the anode surface tends to be high, whereby not only by-products such as thiosulfate ions are likely to form, but also nickel is likely to lead to anode dissolution, such being undesirable. If it is attempted to increase the surface area of the anode to a level larger than 20,000 $m^2/m^3$, a problem in the electrolytic operation is likely to result, such that the pressure loss of the liquid tends to be large, such being undesirable. More preferably, the surface area of the anode per unit volume of the anode compartment is within a range of from 1,000 to 10,000 $m^2/m^3$.

Further, the surface area of the anode is preferably from 2 to 100 $m^2/m^2$ per unit area of the diaphragm partitioning the anode compartment and the cathode compartment. The surface area of the anode is more preferably from 5 to 50 $m^2/m^2$ per unit area of the diaphragm. The average pore diameter of the network of the anode is preferably from 0.1 to 5 mm. If the average pore diameter of the network is larger than 5 mm, the surface area of the anode can not be made large, and the current density at the anode surface tends to be large, whereby not only by-products such as thiosulfate ions are likely to form, but nickel is likely to lead to anode dissolution, such being undesirable. If the average pore diameter of the network is smaller than 0.1 mm, a problem in the electrolytic operation is likely to occur, such that the pressure loss of the liquid tends to be large, such being undesirable. The average pore diameter of the network of the anode is more preferably from 0.2 to 2 mm.

In the anode having a three dimensional network structure, the diameter of the filament material constituting the network is preferably from 0.01 to 2 mm. If the diameter of the filament material is less than 0.01 mm, such a material is difficult to produce, and it is costly and difficult to handle, such being undesirable. If the diameter of the filament material exceeds 2 mm, it tends to be difficult to obtain an anode having a large surface area, and the current density at the anode surface tends to be large, whereby by-products such as thiosulfate ions are likely to be formed, such being undesirable. The diameter of the filament material constituting the network is particularly preferably from 0.02 to 1 mm.

The anode may be disposed fully in the anode compartment so that it is in contact with the diaphragm, or may be disposed so that there will be a certain space between the anode and the diaphragm. It is necessary that a liquid to be treated passes through the anode, and the anode preferably has a sufficient porosity. In either case, the porosity of the anode is preferably from 90 to 99%. If the porosity is less than 90%, the pressure loss at the anode tends to be large, such being undesirable. If the porosity exceeds 99%, the surface area of the anode can hardly be made large, such being undesirable. The porosity is particularly preferably form 90 to 98%. In the technique of (C) JP-11-51033, it has further been found that when a porous anode is employed as an anode, there are important requirements between the porous anode and the diaphragm and between the volume of the anode compartment and the apparent volume of the porous anode, in order to produce a cooking liquor containing a polysulfide sulfur at a high concentration and having a large amount of residual $Na_2S$-state sulfur while maintaining high selectivity and minimizing by-production of thiosulfate ions, and such requirements have been set. By this technique, it is possible to obtain various effects as described above, such that by using the obtained polysulfide cooking liquor for cooking, it is possible to effectively increase the yield of pulp.

It is preferred to carry out the operation at a current density of from 0.5 to 20 $kA/m^2$ at the diaphragm surface. If the current density at the diaphragm surface is less than 0.5 $kA/m^2$, an unnecessarily large electrolytic installation will be required, such being undesirable. If the current density at the diaphragm surface exceeds 20 $kA/m^2$, not only by-products such as thiosulfate, sulfuric acid, oxygen, etc., will be increased, but also nickel is likely to lead to anode dissolution, such being undesirable. The current density at the diaphragm surface is more preferably from 2 to 15 $kA/m^2$. Since the anode having a large surface area relative to the area of the diaphragm, is employed, the operation can be carried out within a range where the current density at the anode surface is small.

This anode has a large surface area, whereby the current density at the anode surface can be made small. On the assumption that the current density is uniform over the surface of various parts of the anode, the current density at the anode surface obtained from the surface area of the anode, is preferably from 5 to 3,000 $A/m^2$. A more preferred range is from 10 to 1,500 $A/m^2$. If the current density at the anode surface is less than 5 $A/m^2$, an unnecessarily large electrolytic installation will be required, such being undesirable. If the current density at the anode surface exceeds 3,000 $A/m^2$, not only by-products such as thiosulfate, sulfuric acid, oxygen, etc., will be increased, but also nickel is likely to lead to anode dissolution, such being undesirable.

This anode has a physically continuous network structure as is different from an aggregate of fibers, and has a sufficient electric conductivity, whereby the porosity of the anode can be made large while maintaining the IR drop at the anode to be small. Accordingly, the pressure loss of the anode can be reduced.

With a view to reducing the pressure loss, it is preferred to maintain the liquid flow in the anode compartment in a laminar flow region having a small flow rate. However, with a laminar flow, the anode solution in the anode compartment will not be stirred, and in some cases, deposition is likely to accumulate on the diaphragm facing the anode compartment, and the cell voltage tends to increase as the time passes. In such a case, even if the flow rate of the anode solution is set to be large, the pressure loss of the anode can be maintained at a low level, whereby there is a merit that the anode solution in the vicinity of the diaphragm surface will be stirred, and the deposition can be made to scarcely accumulate. The average superficial velocity in the anode compartment is preferably from 1 to 30 cm/sec. The flow rate of the cathode solution is not limited and will be determined by the degree of buoyancy of the generated gas. A more preferred range of the average superficial velocity in the anode compartment is from 1 to 15 cm/sec., and a particularly preferred range is from 2 to 10 cm/sec.

As the cathode material, a material having alkali resistance is preferred. For example, nickel, Raney Nickel, steel or stainless steel may be employed. As the cathode, one or more flat plates or meshed sheets may be used in a single or multi-layered structure. Otherwise, a three-dimensional electrode composed of linear electrodes, may also be employed. As the electrolytic cell, a two compartment type electrolytic cell comprising one anode compartment and one cathode compartment, or an electrolytic cell having three or more compartments combined, may be employed. A plurality of electrolytic cells may be arranged in a monopolar structure or a bipolar structure. As the diaphragm partitioning the anode compartment and the cathode compartment, it is preferred to employ a cation exchange membrane. The cation exchange membrane transports cations from the anode compartment to the cathode compartment, and prevents transfer of sulfide ions and polysulfide ions. As the cation exchange membrane, a polymer membrane having cation exchange groups such as sulfonic groups or carboxylic acid groups introduced to a hydrocarbon type or fluororesin type polymer, is preferred. If there will be no problem with respect to e.g. alkali resistance, a bipolar membrane or an anion exchange membrane may, for example, also be used.

The electrolytic conditions such as the temperature, the current density, etc., are preferably adjusted and maintained so that polysulfide ions ($S_x^{2-}$) such as $S_2^{2-}$, $S_3^{2-}$, $S_4^{2-}$ and $S_5^{2-}$ will be formed as oxidation products of sulfide ions, and no thiosulfate ions will be produced as by-products, at the anode. It is thereby possible to form an alkaline cooking liquor having a polysulfide sulfur concentration of from 8 to 20 g/l (l represents litter, and the same applies in the present specification) as a sulfur content, at a high efficiency while minimizing or eliminating by-production of thiosulfate ions by the electrolytic oxidation method of sodium sulfide. Of course, it is possible to form an alkaline cooking liquor having a polysulfide sulfur concentration lower than 8 g/l by selecting the electrolytic conditions such as the temperature, the current density, etc.

In the present invention, an alkaline cooking liquor having a polysulfide sulfur concentration of at least 6 g/l, preferably at least 7 g/l, particularly preferably from 8 to 20 g/l, is used to obtain the characteristics of the electrolytic method as compared with the conventional oxidation method by air. In the method of the present invention wherein a white liquor electrolytic method is employed, it is possible to form chemical solutions having two types of $Na_2S$-state sulfur concentration compositions at the same time as the formation of polysulfide sulfur at a high concentration, whereby polysulfide sulfur and a cooking liquor having a high $Na_2S$-state sulfur concentration, can be supplied at the initial stage of cooking by a very simple process. Further, according to the method of the present invention wherein a white liquor electrolytic method is employed, side-reactions which take place in the case of a conventional oxidation method by air, will not take place, or if take place, they can be controlled to be at a low level, whereby the $Na_2S$ content in the white liquor can be converted to a polysulfide very efficiently, and the polysulfide concentration can be increased at least to a level corresponding to an increase of the $Na_2S$ concentration.

Further, in the white liquor electrolytic method, in addition to the polysulfide cooking liquor containing polysulfide sulfur and $Na_2S$-state sulfur at high concentrations, formed at the anode side, sodium hydroxide containing no sodium sulfide content will be formed as a by-product at the cathode side. Since the electrolytic efficiency is very high, the sum of active alkali in the anolyte and in the catholyte will be substantially the same as active alkali of white liquor introduced into the electrolytic cell. Particularly when white liquor is electrolyzed by an ion exchange membrane method, sodium hydroxide containing no sodium sulfide content, can be obtained, and such a product can be employed for delignification by oxygen or the bleaching stage by hydrogen peroxide.

Further, during the electrolysis, sodium ions (active alkali component) will transfer to the cathode side, whereby in the polysulfide cooking liquor to be formed at the anode side, the sulfur component more active in cooking than the original white liquor will be in a concentrated state relative to the active alkali component. Accordingly, the white liquor electrolytic method has an excellent ability to separate the sulfur component in addition to the excellent ability to produce a polysulfide and is very effective to realize the two stage sulfidity cooking in the present invention.

In the foregoing, description is made with reference to white liquor as an object for the electrolysis. However, as shown in FIG. 3, in the present invention, also from green liquor, a polysulfide of high concentration can be produced by electrolysis (see also a Example given hereinafter). In such a case, as shown in FIG. 3, the obtained highly concentrated polysulfide solution may be supplied to the impregnation stage as it is (as shown by a dotted line in FIG. 3, a part may be supplied to the cooking stage 1), but preferably, after the electrolysis, cauticizing is carried out by a suitable method to secure an alkali concentration required for initial addition, and then the solution is supplied to the impregnation stage.

For example, in the case of white liquor used in kraft pulping which is currently carried out, the composition of the white liquor usually contains from 2 to 6 mol/l of alkali metal ions, and among them, at least 90% is sodium ions, the rest being substantially potassium ions. Further, the anions contain hydroxide ions, sulfide ions and carbonate ions as the main components, and further contain sulfate ions, thiosulfate ions, chlorine ions and sulfite ions, as other ions. They further contain trace amount components such as calcium, silicon, aluminum, phosphorus, magnesium, copper, manganese and iron. On the other hand, the composition of the green liquor contains sodium sulfide and sodium carbonate as the main components, while the main components of the white liquor are sodium sulfide and sodium hydroxide. Other anions and trace amount components in the green liquor, are the same as in the white liquor.

If electrolytic oxidation is carried out by supplying such white liquor or green liquor to the anode compartment, sulfide ions are oxidized to form polysulfide ions, and consequently, alkali metal ions will move to the cathode compartment through the diaphragm to form a hydroxide of an alkali metal (NaOH, partially KOH). In the present invention, the liquid containing the polysulfide ions at a high concentration, thus obtained, is added before the chip has the maximum temperature, and the solution containing the above hydroxide of an alkali metal, obtained, is added to at least one step after the chip has the maximum temperature until the final bleaching stage.

According to the present invention, by combining the electrolytic oxidation method to the conventional process for producing kraft pulp, the yield of pulp can be improved by the formed polysulfide, whereby it is possible to reduce organic substances in the black liquor, and to reduce the load on the boiler attributable to organic substances. Further, according to the present invention, by applying the two stage sulfidity cooking method together with the electrolytic oxidation method, it is possible to reduce the load on the boiler attributable to inorganic substances such as $Na_2SO_4$, by the action of saving chemicals in both methods.

And, the reserve capacity of the recovery boiler obtained by the incorporation of the electrolytic method, can be used for the treatment of organic substances and the recovery of chemicals derived from the bleach effluent, or for the treatment of organic substances and the recovery of chemicals contained in the washing drainage, which enters into a diluted black liquor tank, as shown in FIGS. 1 to 3. As shown in FIGS. 1 to 3, water for washing cleans the pulp after bleaching 3 and becomes bleaching drainage 3; the bleaching drainage 3 cleans the pulp after bleaching 2 and becomes bleaching drainage 2; the bleaching drainage 2 cleans the pulp after bleaching 1 and becomes bleaching drainage 1; and the bleaching drainage 2 cleans the pulp after the step of delignification by oxygen and then is supplied to the diluted black liquor tank. In this case, a part of the bleaching drainage 2 may be supplied to the diluted black liquor tank without passing through the step of delignification by oxygen. In any case, the whole of the washing drainage in the process for producing kraft pulp will be recovered. In the present invention, the electrolytic method is incorporated into the process for producing kraft pulp, and the reserve capacity of the recovery boiler thereby obtained can be used for the treatment of organic substances and the recovery of chemicals contained in the bleaching drainage.

Further, in the present invention, it is very effective for (4) the cooking step to add quinones in the initial stage of the highly concentrated polysulfide cooking. By the co-presence of the polysulfide and quinones at the initial stage of cooking, the stability of polysaccharides and the delignification rate in the cooking step will be accelerated, whereby it will be made possible to substantially improve the yield of pulp and to save alkali, i.e. to reduce the load on the boiler attributable to organic substances and inorganic substances.

The quinone compound to be used, is a quinone compound so-called a known cooking assistant, a hydroquinone compound or a precursor thereof. At least one compound selected from such compounds, may be used. Such compounds, may, for example, be a quinone compound such as anthraquinone, dihydroanthraquinone (such as 1,4-dihydroanthraquinone), tetrahydroanthraquinone (such as 1,4,4a,9a-tetrahydroanthraquinone or 1,2,3,4-tetrahydroanthraquinone), methylanthraquinone, (such as 1-methylanthraquinone or 2-methylanthraquinone), methyldihydroanthraquinone (such as 2-methyl-1,4-dihydroanthraquinone), methyltetrahydroanthraquinone (such as 1-methyl-1,4,4a,9a-tetrahydroanthraquinone or 2-methyl-1,4,4a,9a-tetrahydroanthraquinone), a hydroquinone compound such as anthrahydroquinone (usually, 9,10-dihydroxyanthracene), methylanthrahydroquinone (such as 2-methylanthrahydroquinone), dihydroanthrahydroanthraquinone (such as 1,4-dihydro-9,10-dihydroxyanthracene) or its alkali metal salt (such as a disodium salt of anthrahydroquinone, or a disodium salt of 1,4-dihydro-9,10-dihydroxyanthracene), and a precursor thereof, such as anthrone, anthranol, methyl anthrone or methyl anthranol. Such a precursor has a possibility of being converted to a quinone compound or a hydroquinone compound under the cooking conditions.

Further, according to the present invention, an excess alkali content in cooking by the white liquor electrolytic method may be used for the bleaching step as a solution containing no substantial sodium sulfide, to be formed at the cathode side during the electrolysis, whereby it is possible to minimize breakage of the sodium/sulfur balance when the bleached white liquor (washing drainage) is recovered by the recovery boiler and to provide a highly efficient method for recovery of chemicals for kraft cooking, which is suitable for a closed system of the process for producing kraft pulp.

The oxidized white liquor to be used for e.g. bleaching by oxygen, as an alkali source to be recovered, has been heretofore formed by oxidizing a sodium sulfide component in white liquor to sodium thiosulfate, as in the above-mentioned method for oxidation by air employing an active carbon catalyst. However, in such a case, the active alkali component corresponding to the component of formed sodium thiosulfate, will be lost. Whereas, in the white liquor electrolytic method used in the present invention, no substantial loss of such an alkali component will result during the reaction, whereby it can be supplied as an alkali source to at least one step after the chip has the maximum temperature till the final bleaching stage, i.e. to the cooking stage 1, the cooking stage 2, the stage of delignification by oxygen, the bleaching 2 and the bleaching 3 as shown in FIGS. 1 to 3.

Further, according to the electrolytic method used in the present invention, hydrogen will be formed as a by-product in the cathode compartment (the cathode side) of the electrolytic cell. In the present invention, this hydrogen is used as the feed material to produce hydrogen peroxide, and this hydrogen peroxide is used for a bleaching step i.e. bleaching 1 to 3 as shown in FIGS. 1 to 3, whereby use of a chlorine-type chemical for such bleaching can be avoided or avoided as far as possible, and the process for producing kraft pulp, can be made closed. It is thereby possible to avoid or avoid as far as possible discharge of a chlorine-type organic substance from the process for producing kraft pulp, and substantially no chlorine-type hazardous substance will be contained also in the product pulp, such being very effective also in consideration of the pollution to the environment. Further, hydrogen as the feed material is thus a by-product from the electrolytic cell, whereby hydrogen peroxide can be obtained effectively and inexpensively in the plant for producing pulp, such being very advantageous also from the viewpoint of costs.

According to the present invention, all alkaline solutions containing $Na_2S$ flowing in the process for producing kraft pulp can be used as an object to be treated by the electrolysis. In such a case, the entire amount of the alkaline solutions containing $Na_2S$ to be subjected to cooking, may be an object to be treated. However, the yield of pulp can further be increased by optimizing the amount to be treated by electrolysis depending upon the method for cooking or the required amount of a NaOH solution containing no $Na_2S$, whereby the load on the boiler due to the black liquor, can be reduced.

In a digester of the type wherein addition of cooking liquor can not be carried out in a divided fashion i.e. there is only one position at which the cooking liquor is supplied to the chip, it is most preferred to adjust the amount for the electrolytic treatment so that the $Na_2S$-state sulfur concentration immediately after the cooking liquor is supplied to the chip will not be lower than 10 g/l (as $Na_2O$), and the ratio of the active alkali added to the chip will not be lower than 13%.

Further, in a digester of the type where the cooking liquor can be added in a divided fashion after the temperature-adjusted circulation for cooking till circulation at the bottom of the digester, at least a part of the polysulfide cooking liquor having concentrated the sulfur component formed at the anode in the white liquor electrolytic cell, is initially added before the circulation at the top (before the circulation at the top of a impregnation vessel in the case of a continuous digester having such a impregnation vessel), and subsequently, the liquid containing at least the NaOH solution formed at the cathode in the white liquor electrolytic cell is added at an intermediate point so that the pH in the continuous digester will not be 10 or less.

A part of the catholyte or white liquor may be used to adjust the active alkali concentration immediately it after the addition at the initial stage to be at least 40 g/l. However, it is more preferred to adjust the white liquor concentration so that the active alkali concentration immediately after the addition at the initial stage will be at least 40 g/l and at most 100 g/l by the entire amount of the catholyte. Further, the alkali source to be added to maintain the pH during the cooking at a level of at least 10, is most preferably the catholyte. However, if the formed catholyte is not sufficient to meet the required amount, white liquor may be used as an alkali. If an alkaline solution is further required, the anolyte may also be used as an alkali source. It is most preferred to use a part of the catholyte to maintain the pH to form an excess catholyte, which is used for a bleaching step.

Even by the white liquor electrolytic method, a polysulfide will be formed from $Na_2S$ in the white liquor, and accordingly, if an unnecessarily high concentration of a polysulfide is formed, the $Na_2S$-state sulfur concentration will be lower than the required minimum level. The higher the polysulfide sulfur concentration, the better. However, it is preferably within a range of from 6 to 15 g/l (as sulfur) for an improvement of the yield i.e. as the effect for reducing the load on the boiler is large. Further, in a case where addition is carried out in a divided fashion, it is necessary to carry out the polysulfide formation so that the $Na_2S$-state sulfur concentration immediately after the cooking liquor is supplied, will not be lower than 5 g/l (as $Na_2O$).

Further, as the type of the liquid to be treated, all alkaline solutions containing $Na_2S$ derived from recovery boilers may be objects to be treated. However, if the solution to be treated has a low $Na_2S$ concentration like a weak liquor or the bleach effluent, the electrolytic installation is required to be large, or concentration is required at the time of using the electrolytic product. Accordingly, it is desired to have a $Na_2S$ concentration composition at a level of white liquor or green liquor. Further, the polysulfide will be decomposed by heat or oxidation by air, and in order to maximize the reduction of the load on the boiler due to black liquor, by an improvement in the yield of pulp, it is most preferred to use an alkaline solution containing $Na_2S$ immediately before being supplied to the chip at the top of the digester (at the top of the impregnation vessel in the case where the digester has the impregnation vessel), i.e. white liquor, as the object to be treated.

Now, the present invention will be described in further detail with reference to Examples. However, it should be understood that the present invention is by no means restricted to such Examples.

Further, in the following, ECF bleaching is an abbreviation of ECF (Elemental Chlorine Free) bleaching and represents chlorine-free bleaching using no chlorine, and TCF bleaching is an abbreviation of TCF (Totally Chlorine Free) bleaching and represents completely chlorine-free bleaching employing absolutely no chlorine-type bleaching agent (such as chlorine dioxide or a hypochlorite). Further, the value of NaOH to be used hereinafter is meant for a value calculated as $Na_2O$ in a cooking step and is meant for a value calculated as NaOH in a step of delignification by oxygen and in a bleaching step.

Comparative Example 1

All at Once, KP, Oxidized White Liquor

As a test sample chip, a chip of an imported broad leaf tree material, was charged into a digester, and white liquor having the following composition was added to the digester all at once. The amount of white liquor required to obtain a pulp having a Kappa number of 20, was obtained, and its solid content was used as a standard value for the load of an inorganic solid content of the boiler exerted to the digester. Further, from the total yield of pulp (pulp and non-cooked residue) at that time, the reduction in yield during the cooking was obtained and used as a standard value for the load of the organic solid content of the boiler exerted to the digester. The conditions for the cooking were as follows.

Composition of White Liquor

| | |
|---|---|
| Active alkali concentration | 100 g/l |
| Sulfidity | 30% |

Conditions for Cooking

| | |
|---|---|
| Liquor ratio | 2.5 l/kg |
| Maximum temperature | 160° C. |
| Maximum temperature maintaining time | 90 min. |

Delignification by oxygen of the cooked pulp was carried out under the following conditions, and the addition of NaOH was adjusted to obtain the amount of NaOH required to obtain a pulp having a Kappa number of 10. The amount of oxidized white liquor giving the required amount of NaOH was calculated together with the following composition of oxidized white liquor, and the total solid content thereof was used as a standard value for the load of the inorganic solid content of the boiler exerted for delignification by oxygen. Further, from the yield of the pulp at that time, the reduction in yield during the delignification by oxygen, was obtained and used as a standard value for the load of the organic solid content of the boiler exerted for delignification by oxygen.

The delignification by oxygen was carried out by means of a pressurizing type batch system high shearing stirrer (Laboratory Mixer MARK IV, manufactured by Quantum Technologies Inc.). The pulp was introduced and tightly sealed, whereupon oxygen stored in a cylinder and an aqueous solution of sodium hydroxide were simultaneously injected under pressure into the reaction container. At the same time as the addition of chemicals, stirring at 600 rpm for 4 seconds and subsequent stirring at 1200 rpm for 4 seconds, were carried out to uniformly disperse the pulp, chemicals and oxygen, and intermittent stirring (600 rpm, 4 seconds) was carried out every 30 seconds to maintain the temperature.

Conditions for Delignification by Oxygen

| | |
|---|---|
| Amount of sodium hydroxide added | 1.5 (wt % relative to absolutely dried pulp) |
| Amount of oxygen added | 1.7 (wt % relative to absolutely dried pulp) |
| Concentration of pulp | 10.5 (wt %) |
| Reaction temperature | 98° C. |
| Reaction time | 60 min. |
| Initial oxygen pressure | 7.5 kg/cm$^2$ |

Composition of Oxidized White Liquor

| | |
|---|---|
| NaOH | 109.3 g/l (as NaOH) |
| $Na_2S$ | 2.5 g/l (as $Na_2S$) |
| $Na_2S_2O_3$ | 33.7 g/l (as $Na_2S_2O_3$) |

Further, the Kappa number was measured in accordance with TAPPI T230 om-8. The results are shown in Table 1. Thereafter, post bleaching was carried out in a bleaching sequence of chlorine-alkali-hypo-chlorine dioxide, to obtain a pulp having a whiteness degree of 86, but the white liquor derived from the post bleaching step (washing drainage) was not recovered for a boiler, since chlorine-type substances were contained, and it was not added to the boiler load. The boiler load of organic substances and inorganic substances relating to the cooking and delignification by oxygen, and the boiler load of the total organic substances and inorganic substances, are shown in Tables 1 and 2.

Conditions for Post Bleaching

Bleaching by Chlorine

| | |
|---|---|
| The amount of chlorine added | 2 (wt % of effective chlorine relative to absolutely dried pulp) |
| Pulp concentration | 3 (wt %) |
| Reaction temperature | 45° C. |
| Reaction time | 30 min. |

Alkali Extraction Stage

| | |
|---|---|
| Amount of sodium hydroxide added | 1.0 (wt % relative to absolutely dried pulp) |
| Pulp concentration | 10 (wt %) |
| Reaction temperature | 60° C. |
| Reaction time | 60 min. |

Hypochlorite Bleaching

| | |
|---|---|
| Amount of hypochlorite added | 0.3 (wt % of effective chlorine relative to absolutely dried pulp) |
| Pulp concentration | 10 (wt %) |
| Reaction temperature | 45° C. |
| Reaction time | 120 min. |

Chlorine Dioxide Bleaching

| | |
|---|---|
| Amount of chlorine dioxide added | 0.4 (wt % of effective chlorine relative to absolutely dried pulp) |
| Pulp concentration | 10.5 (wt %) |
| Reaction temperature | 75° C. |
| Reaction time | 18 |

Comparative Example 2

All at Once, PS, Oxidized White Liquor

A test was carried out under the same conditions as in Comparative Example 1 except that white liquor having the same composition as used for cooking in Comparative Example 1, was oxidized by air to obtain a polysulfide cooking liquor, which was used for cooking. In the polysulfide cooking, the polysulfide cooking liquor was used for the cooking. But the amount of white liquor required to obtain the polysulfide cooking liquor was obtained rather than the amount of the polysulfide cooking liquor required to obtain a pulp having a Kappa number of 20, for the calculation of the load of an inorganic solid content of the boiler. Further, the oxidation by air of the white liquor was carried out so that the conditions for forming the polysulfide by the oxidation of white liquor by air would be to bring the oxidation ratio to 60% (the ratio of $Na_2S$ changed by oxidation by air) and the oxidation efficiency to 50% (the proportion of $Na_2S$ capable of presenting polysulfide sulfur among the changed $Na_2S$). The boiler load of organic substances and inorganic substances relating to the cooking and delignification by oxygen, and the total boiler load of organic substances and inorganic substances are shown in Tables 1 and 2.

EXAMPLE 1

All at once, Electrolysis, Oxidized White Liquor

A test was carried out under the same conditions as in Comparative Example 1 except that a white liquor having the same composition as in Comparative Example 1 was oxidized by a white liquor electrolytic method, and the obtained anolyte (anode solution) and catholyte (cathode solution) were put together and added to the digester all at once. The boiler load of organic substances and inorganic substances relating to the cooking and delignification by oxygen, and the total boiler load of organic substances and inorganic substances are shown in Tables 1 and 2 together with the ratio to the load in Comparative Example 1.

The conditions for the above white liquor electrolysis were as follows. A two compartment type electrolytic cell was assembled which comprised a nickel porous body as an anode (the surface area of the anode per volume of the anode compartment: 5600 $m^2/m^3$, average pore diameter of the network: 0.51 mm, surface area to the diaphragm area: 28 $m^2/m^3$), an iron expansion metal as a cathode and a fluorine resin type cation exchange membrane as a diaphragm. To this electrolytic cell, the white liquor having the same composition as in Comparative Example 1, was introduced, and electrolysis was carried out at an electrolytic temperature of 85° C. at a current density at the diaphragm of 6 kA $m^2$, to obtain a polysulfide cooking liquor having a polysulfide sulfur concentration of 9 g/l at a current efficiency of 95%. The concentration of by-product sodium thiosulfate was as little as 0.6 g/l. Further, at the cathode side, NaOH was formed at a current efficiency of 80%, and the amount of water added, was adjusted to obtain an aqueous NaOH solution having a 10% concentration.

EXAMPLE 2

All at Once, Electrolysis, NaOH Oxygen Delignification

A test was carried out under the same conditions as in Comparative Example 1 except that a white liquor having the same composition as in Comparative Example 1 was oxidized by a white liquor electrolytic method in the same manner as in Example 1, and in addition to the obtained anolyte, the catholyte except for the NaOH component required for the delignification by oxygen, was put together and added to the digester all at once, and during the delignification by oxygen, a required amount of the catholyte formed by the white liquor electrolysis was added instead of the oxidized white liquor. The boiler load of organic substances and inorganic substances relating to the cooking and delignification by oxygen, and the total boiler load of organic substances and inorganic substances, are shown in Tables 1 and 2 together with the ratio to the load in Comparative Example 1.

EXAMPLE 3

All at Once Electrolysis, TCF Bleaching

A test was carried out under the same conditions as in Example 2 except that post bleaching after the oxygen delignification stage was in a multi stage bleaching sequence of ozone bleaching-alkaline hydrogen peroxide bleaching-alkaline hydrogen peroxide bleaching, and also for NaOH required for the post bleaching, the catholyte by the white liquor electrolytic method, was employed. The conditions for the post bleaching were as follows, and all white liquor (washing water) resulting from the post bleaching was regarded as recoverable and reused for the boiler and the reduction in yield and the amount of required NaOH were added in the calculation of the boiler load.

Conditions for the Post Bleaching

Ozone Bleaching; Post Bleaching 1

| | |
|---|---|
| Amount of sulfuric acid added | 0.75 (wt % relative to absolutely dried pulp) |
| The amount of ozone added | 0.5 (wt % relative to absolutely dried pulp) |
| Pulp concentration | 10.5 (wt %) |
| Reaction temperature | 75° C. |
| Reaction time | 180 min. |

Alkaline Hydrogen Peroxide Bleaching: Post Bleaching 2

| | |
|---|---|
| Amount of sodium hydroxide added | 1.2 (wt % relative to absolutely dried pulp) |
| Amount of hydrogen peroxide added | 1.0 (wt % relative to absolutely dried pulp) |
| Pulp concentration | 10.5 (wt %) |
| Reaction temperature | 80° C. |
| Reaction time | 120 min. |

Alkaline Hydrogen Peroxide Bleaching: Post Bleaching 3

| | |
|---|---|
| Amount of sodium hydroxide added | 0.5 (wt % relative to absolutely dried pulp) |
| Amount of hydrogen peroxide added | 1.0 (wt % relative to absolutely dried pulp) |
| Pulp concentration | 10.5 (wt %) |
| Reaction temperature | 80° C. |
| Reaction time | 120 min. |

The boiler load of organic substances and inorganic substances relating to the cooking, delignification by oxygen and post bleaching, and the total boiler load of organic substances and inorganic substances, are shown in Tables 1 and 2 together with the ratio to the load in Example 1.

In the foregoing, Comparative Examples 1 and 2 and Examples 1 and 2 show the results of cooking by addition all at once wherein chemicals for cooking are added only to the impregnation stage. In Comparative Example 2 wherein the conventional oxidation method by air was used, and in Examples 1 and 2 of the present invention wherein the electrolytic method was applied, the load of the organic solid content can be reduced due to the effect of improving the yield, as compared with Comparative Example 1 which is a conventional method wherein white liquor was added as it was. However, in Examples 1 and 2 wherein the electrolytic method was applied, the effect for improving the yield is higher as compared with Comparative Example 2 wherein a conventional oxidation method by air was used, whereby the load of an organic solid content can further be reduced. Namely, as shown in Table 1, the organic load ratio is high at 100% in Comparative Example 1 and at 96.8% also in Comparative Example 2, whereas it is effectively improved to a level of 94.0% in both Examples 1 and 2.

Further, in the present invention, the effect obtainable by application of the electrolytic method is apparent also with respect to the load of an inorganic solid content. Namely, as shown in Table 2, in Comparative Example 1 and Comparative Example 2, the load ratio is as high as 100% and 101.3%, respectively, whereas it is effectively improved at a level of 95.2% in Example 1 and 94.5% in Example 2. It is apparent that such effects are effective and excellent effects, taking into consideration a point such that the process for producing kraft pulp as an object of the present invention is a technique to treat a large quantity of a chip.

By carrying out TCF bleaching and recovering the washing water, as in Example 3, the load of an inorganic solid content of the boiler increases. However, in the present invention, ① by the effect of saving chemicals for cooking, which the high concentration polysulfide produced by the electrolytic method, itself, has, and ② by converting the oxidized white liquor for oxygen bleaching to NaOH obtainable by electrolysis, it is possible to eliminate a loss during the production of oxidized white liquor and to improve the bleaching effects.

EXAMPLE 4

All at Once, Electrolysis, TCF Bleaching

A test was carried out under the same conditions as in Example 3 except that SAQ (registered trademark for a disodium salt of 1,4-dihydro-9,10-dihydroxyanthracene, manufactured by Kawasaki Kasei Chemicals Ltd.) was added in an amount of 0.03 wt % per absolutely dried chip, before the chip had the maximum temperature. The boiler load of organic substances and inorganic substances relating to the cooking and delignification by oxygen, and the total boiler load of organic substances and inorganic substances are shown in Tables 1 and 2 together with the ratio to the load in Example 1. No change was observed in the bleaching property or the bleaching yield, but the boiler load was reduced than in Example 3, and in spite of the load attributable to the recovery of the TCF bleached white liquor for the boiler, the boiler load was reduced, and the effect of reducing the inorganic load was particularly remarkable.

Comparative Example 3

Dividedly Added KP, Oxidized White Liquor

A test was carried out under the same conditions as in Comparative Example 1 except that 70% (volume) of a white liquor having the same composition as in Comparative Example 1 was charged and added to the chip, and the rest of 30% was added to the temperature adjusted circulation (at the time when the maximum temperature was reached). The boiler load of organic substances and inorganic substances relating to the cooking and delignification by oxygen, and the total boiler load of organic substances and inorganic substances, are shown in Tables 1 and 2 together with the ratio to the load in Comparative Example 1.

Comparative Example 4

Dividedly Added, PS, Oxidized White Liquor

A test was carried out under the same conditions as in Comparative Example 2 except that 70% (volume) of the polysulfide cooking liquor formed, was charged and added to the chip, and the rest of 30% was added to the temperature adjusted circulation (at the time when the maximum temperature was reached). The boiler load of organic substances and inorganic substances relating to the cooking and delignification by oxygen, and the total boiler load of organic substances and inorganic substances, are shown in Tables 1 and 2 together with the ratio to the load in Comparative Example 1.

EXAMPLE 5

Dividedly Added, Electrolysis, Oxidized White Liquor

A test was carried out under the same conditions as in Example 1 except that the anolyte obtained by a white liquor electrolytic method was charged and added to the chip, and the catholyte was added to the temperature adjusting circulation (at the time when the maximum temperature was reached). The boiler load of organic substances and inorganic substances relating to the cooking and delignification by oxygen, and the total boiler load of organic substances and inorganic substances, are shown in Tables 1 and 2 together with the ratio to the load in Comparative Example 1.

EXAMPLE 6

Dividedly Added, Electrolysis NAOH Oxygen Delignification

A test was carried out under the same conditions as in Example 2 except that the white liquor was oxidized by a white liquor electrolytic method, and the obtained anolyte was charged and added to the chip, and the catholyte obtained by removing the NaOH component required for the delignification by oxygen, was added to the temperature-adjusted circulation (at the time when the maximum temperature was reached). The boiler load of organic substances and inorganic substances relating to the cooking and delignification by oxygen, and the total boiler load of organic substances and inorganic substances, are shown in Tables 1 and 2 together with the ratio to the load in Comparative Example 1.

EXAMPLE 7

Dividedly Added, Electrolysis, ECF Bleaching

A test was carried out under the same conditions as in Example 3 except that the white liquor was oxidized by a white liquor electrolytic method, and the obtained anolyte was charged and added to the chip, and the catholyte obtained by removing the NaOH component required for the bleaching after the delignification by oxygen, was added to the temperature adjusted circulation (at the time when the maximum temperature was reached). The white liquor for the ozone bleaching and the alkaline hydrogen peroxide bleaching was regarded as recovered and reused for the boiler, and the reduction in yield and the required amount of NaOH were added in the calculation for the boiler load.

EXAMPLE 8

Dividedly Added, Electrolysis, TCF Bleaching

A test was carried out under the same conditions as in Example 3 except that the white liquor was oxidized by a white liquor electrolytic method, and the obtained anolyte was charged and added to the chip, and the catholyte obtained by removing the NaOH component required for the bleaching after the delignification by oxygen, was added to the temperature adjusted circulation (at the time when the maximum temperature was reached). All white liquor resulting from the post bleaching was regarded as recovered and reused in the boiler, and the reduction in the yield and the required amount of NaOH were added in the calculation for the boiler load.

By carrying out the TCF bleaching and recovering the washing water as in Example 8, the load of an inorganic solid content of the boiler increases. However, in the present invention, ① by the effect of saving chemicals for cooking which high concentration polysulfide produced by the electrolytic method itself has, and ② by converting the oxidized white liquor for the oxygen bleaching to NaOH obtainable by electrolysis, it is possible to eliminate a loss during the production of oxidized white liquor and to reduce the load of an inorganic solid content of the recovery boiler even when the washing water is recovered.

EXAMPLE 9

Dividedly Added, Electrolysis, TCF Bleaching

A test was carried out under the same conditions as in Example 8 except that as the hydrogen peroxide to be used for the post bleaching, hydrogen peroxide prepared by using hydrogen by-produced during the white liquor electrolysis as the raw material. The bleaching property and the boiler load were the same as in Example 8, but hydrogen peroxide was produced onsite and accordingly was not required to be concentrated or transported, and further the raw material hydrogen is a by-product from the white liquor electrolytic cell, whereby the hydrogen peroxide can be obtained very effectively and inexpensively in the plant for producing pulp.

EXAMPLE 10

Dividedly Added, Electrolysis, TCF Bleaching

A test was carried out under the same conditions as in Example 8 except that SAQ (registered trademark for a disodium salt of 1,4-dihydro-9,10-dihydroxyanthracene, manufactured by Kawasaki Kasei Chemicals Ltd.) was added in an amount of 0.03 wt % per absolutely dried chip, before the chip had the maximum temperature. The boiler load of organic substances and inorganic substances relating to the cooking and delignification by oxygen, and the total boiler load of organic substances and inorganic substances, are shown in Tables 1 and 2 it together with the ratio to the load in Comparative Example 1. No change was observed in the bleaching property or in the bleaching yield, but the boiler load was reduced than in Example 8, and in spite of the load attributable to the recovery of the TCF bleached white liquor for the boiler, the boiler load was reduced.

In the foregoing, Comparative Examples 3 and 4 and Examples 5 to 10 show the results of cooking by addition in a divided fashion wherein addition of chemicals for cooking is carried out also to the cooking stage 1 which is a site subsequent to the impregnation stage. However, in Comparative Examples 3 and 4 which are conventional methods wherein the white liquor was added as it is, or a polysulfide cooking liquor obtained by an air oxidation method, was added, no substantial effect for reducing the load of an organic solid content, was obtained. Whereas, in Examples 5 to 10 wherein the electrolytic method was applied, and the cooking by addition in a divided fashion was applied, the load of an organic solid content could further be reduced. Namely, as shown in Table 1, the organic load ratio is high at a level of 99.3% in Comparative Example 3 and 99.1% also in Comparative Example 4. Whereas, in both Examples 5 and 6, it is lower by 9 points at a level of 90.2%, and also in Examples 7 to 10, it is effectively improved. Further, even in the case of cooking by addition all at once in Example 4, or in the case of cooking by addition in a divided fashion of Example 10, by the addition of SAQ, the load of an organic solid content is further reduced as compared with Example 3 and Example 8, respectively. In this respect, as shown in Table 2, a similar improvement is observed with respect to the load of an inorganic solid content. It is evident that such effects are effective and excellent effects taking into consideration a point that the process for producing kraft pulp as an object of the present invention, is a technique to treat a large amount of a chip.

TABLE 1

Loads of organic solid contents disclosed in Examples and Comparative Examples

| | Conditions for cooking | | | Yield in each stage | | | | | | | |
|---|---|---|---|---|---|---|---|---|---|---|---|
| | Mode of addition | Cooking liquor | Mode of bleaching | Non-bleached yield | Oxygen delignification yield | Z-yield | P-yield | P2-yield | Non-recovery bleaching yield | Total organic load (t) | Organic load ratio |
| Comp. Ex. 1 | All at once | WL | Oxidized white liquor | 53.3% | 97.2% | — | — | — | 96.4% | 965 | 100.0% |
| Comp. Ex. 2 | All at once | OL | Oxidized white liquor | 54.2% | 97.1% | — | — | — | 96.4% | 933 | 96.8% |
| Ex. 1 | All at once | EOL | Oxidized white liquor | 55.0% | 97.0% | — | — | — | 96.4% | 907 | 94.0% |
| Ex. 2 | All at once | EOL | NaOH | 55.0% | 97.0% | — | — | — | 96.4% | 907 | 94.0% |
| Ex. 3 | All at once | EOL | TCF | 55.0% | 97.0% | 97.5% | 98.8% | 99.0% | — | 965 | 100.1% |
| Ex. 4 | All at once | EOL | TCF | 56.0% | 97.0% | 97.5% | 98.8% | 99.0% | — | 930 | 96.4% |
| Comp. Ex. 3 | Divided | WL | Oxidized white liquor | 53.6% | 97.0% | — | — | — | 96.4% | 958 | 99.3% |
| Comp. Ex. 4 | Divided | OL | Oxidized white liquor | 53.7% | 96.9% | — | — | — | 96.4% | 956 | 99.1% |
| Ex. 5 | Divided | EOL | Oxidized white liquor | 56.0% | 97.1% | — | — | — | 96.4% | 870 | 90.2% |

TABLE 1-continued

Loads of organic solid contents disclosed in Examples and Comparative Examples

| | Conditions for cooking | | | Yield in each stage | | | | | | | |
|---|---|---|---|---|---|---|---|---|---|---|---|
| | Mode of addition | Cooking liquor | Mode of bleaching | Non-bleached yield | Oxygen delignification yield | Z-yield | P-yield | P2-yield | Non-recovery bleaching yield | Total organic load (t) | Organic load ratio |
| Ex. 6 | Divided | EOL | NaOH | 56.0% | 97.1% | — | — | — | 96.4% | 870 | 90.2% |
| Ex. 7 | Divided | EOL | ECF | 56.0% | 97.1% | 97.5% | 98.8% | — | 99.5% | 914 | 94.7% |
| Ex. 8 | Divided | EOL | TCF | 56.0% | 97.1% | 97.5% | 98.8% | 99.0% | — | 928 | 96.2% |
| Ex. 9 | Divided | EOL | TCF(P) | 56.0% | 97.1% | 97.5% | 98.8% | 99.0% | — | 928 | 96.2% |
| Ex. 10 | Divided | EOL | TCF | 56.2% | 97.1% | 97.5% | 98.8% | 99.0% | — | 922 | 95.5% |

Explanation about abbreviations used in Table 1
WL: White liquor
AA: Activate alkali calculated as $Na_2O$
OL: PS cooking liquor by an air oxidation method
Z: Ozone bleaching
EOL: PS cooking liquor by a white liquor electrolytic method
P: Hydrogen peroxide bleaching
P2: 2nd stage hydrogen peroxide bleaching
Oxidized white liquor: oxygen delignification was carried out by oxidized white liquor obtained by an air oxidation method, and as an alkali source for the subsequent bleaching, NaOH from outside of the system, was used.
NaOH oxygen delignification: At least a part of the catholyte of the white liquor electrolytic method, was used for oxygen delignification, and as an alkali source for the subsequent bleaching, NaOH from outside of the system, was used.
ECF: At least a part of the catholyte of the white liquor electrolytic method was used for the oxygen delignification and the subsequent hydrogen peroxide (P1) stage, and as an alkali source for the subsequent bleaching, NaOH from outside of the system, was used.
TCF: At least a part of the catholyte of the white liquor electrolytic method, was used for the oxygen delignification and all of the subsequent alkaline bleaching stages. Note) Effluent in the bleaching stage wherein NaOH from outside of the system, was used, was not recovered for the boiler and will not be included in the boiler load.
Non-recovery bleaching yield: The product of yields in the respective bleaching stages wherein recovery of effluent for the boiler was not carried out.
Total organic load: The value when 1000t of non-bleached absolutely dried pulp is produced.

TABLE 2

Loads of inorganic solid contents disclosed in Examples and Comparative Examples

| | Conditions for cooking | | | NaOH (AA) addition ratio in each stage | | | | | | |
|---|---|---|---|---|---|---|---|---|---|---|
| | Mode of addition | Cooking liquor | Mode of bleaching | Cooking AA addition ratio | Oxygen delignification NaOH addition ratio | P NaOH addition ratio | P2 NaOH addition ratio | Non-recovery bleaching NaOH addition ratio | Total required load AA (t) | Inorganic load ratio |
| Comp. Ex. 1 | All at once | WL | Oxidized white liquor | 13.5% | 1.5% | — | — | 1.0% | 285 | 100.0% |
| Comp. Ex. 2 | All at once | OL | Oxidized white liquor | 13.9% | 1.5% | — | — | 1.0% | 288 | 101.3% |
| Ex. 1 | All at once | EOL | Oxidized white liquor | 13.2% | 1.5% | — | — | 1.0% | 271 | 95.2% |
| Ex. 2 | All at once | EOL | NaOH oxygen delignification | 13.2% | 1.5% | — | — | 1.0% | 269 | 94.5% |
| Ex. 3 | All at once | EOL | TCF | 13.2% | 1.5% | 1.2% | 0.5% | — | 286 | 100.3% |
| Ex. 4 | All at once | EOL | TCF | 11.9% | 1.5% | 1.2% | 0.5% | — | 256 | 89.9% |
| Comp. Ex. 3 | Divided | WL | Oxidized white liquor | 13.3% | 1.5% | — | — | 1.0% | 280 | 98.3% |
| Comp. Ex. 4 | Divided | OL | Oxidized white liquor | 14.2% | 1.5% | — | — | 1.0% | 298 | 104.5% |
| Ex. 5 | Divided | EOL | Oxidized white liquor | 12.8% | 1.5% | — | — | 1.0% | 259 | 90.8% |

TABLE 2-continued

Loads of inorganic solid contents disclosed in Examples and Comparative Examples

| | Conditions for cooking | | | NaOH (AA) addition ratio in each stage | | | | | | |
|---|---|---|---|---|---|---|---|---|---|---|
| | Mode of addition | Cooking liquor | Mode of bleaching | Cooking AA addition ratio | Oxygen delignification NaOH addition ratio | P NaOH addition ratio | P2 NaOH addition ratio | Non-recovery bleaching NaOH addition ratio | Total required load AA (t) | Inorganic load ratio |
| Ex. 6 | Divided | EOL | NaOH oxygen delignification | 12.8% | 1.5% | — | — | 1.0% | 257 | 90.1% |
| Ex. 7 | Divided | EOL | ECF | 12.8% | 1.5% | 1.2% | — | 0.0% | 268 | 94.0% |
| Ex. 8 | Divided | EOL | TCF | 12.8% | 1.5% | 1.2% | 0.5% | — | 273 | 95.9% |
| Ex. 9 | Divided | EOL | TCF(P) | 12.8% | 1.5% | 1.2% | 0.5% | — | 273 | 95.9% |
| Ex. 10 | Divided | EOL | TCF | 12.3% | 1.5% | 1.2% | 0.5% | — | 263 | 92.2% |

Explanation about abbreviations used in Table 2
WL: White liquor
AA: Activate alkali calculated as $Na_2O$
OL: PS cooking liquor by an air oxidation method
Z: Ozone bleaching
EOL: PS cooking liquor by a white liquor electrolytic method
P: Hydrogen peroxide bleaching
P2: 2nd stage hydrogen peroxide bleaching
Oxidized white liquor: Oxygen delignification was carried out by oxidized white liquor obtained by an air oxidation method, and as an alkali source for the subsequent bleaching, NaOH from outside of the system, was used.
NaOH oxygen delignification: At least a part of the catholyte of the white liquor electrolytic method, was used for oxygen delignification, and as an alkali source for the subsequent bleaching, NaOH from outside of the system, was used.
ECF: At least a part of the catholyte of the white liquor electrolytic method was used for the oxygen delignification and the subsequent hydrogen peroxide (P1) stage, and as an alkali source for the subsequent bleaching, NaOH from outside of the system, was used.
TCF: At least a part of the catholyte of the white liquor electrolytic method, was used for the oxygen delignification and all of the subsequent alkaline bleaching stages. Note) Effluent in the bleaching stage wherein NaOH from outside of the system, was used, was not recovered for the boiler and will not be included in the boiler load.
Non-recovered bleaching: Each bleaching stage in which recovery of effluent for the boiler is not carried out.
Required total AA: Value when 1000t of non-bleached absolutely dried pulp is produced.

INDUSTRIAL APPLICABILITY

According to the present invention, in the process for producing kraft pulp, the bleaching step can be made to be a closed system without destroying the material balance, by employing an alkali formed by an electrolytic oxidation method by using an alkali source in the system. Further, according to the present invention, a large amount of polysulfide is formed by the electrolytic oxidation method, whereby it is possible to improve the yield of pulp and to reduce the amount of chemicals required for cooking. Still further, according to the present invention, effective and excellent effects can be obtained such that formation of carbon dioxide gas, generation of an organic chlorine compound, and environmental problem relating to e.g. the amount of waste water, can be minimized.

What is claimed is:

1. A method for recovering at least one chemical in a process for producing a kraft pulp, said method comprising electrolyzing an alkaline solution containing $Na_2S$ by an electrolytic oxidation method, said alkaline solution flowing in said process, forming a liquid containing a polysulfide sulfur in an amount of 6 g/l or more at an anode side, adding said liquid to said process before a chip has a maximum temperature, optionally causticizing said liquid before adding said liquid to said process, adding an NaOH solution formed at a cathode side to at least one stage among after said chip has said maximum temperature through a final bleaching stage, and recovering and reusing at chemicals obtained from at least one stage added said NaOH, which chemicals among a plurality of chemicals discharged from a cooking step through a final bleaching stage, or mixture thereof.

2. The method as claimed in claim 1, wherein said alkaline solution being electrolyzed is a portion of said alkaline solution containing $Na_2S$ flowing in said process for producing kraft pulp, wherein said alkaline solution is not electrolyzed and may optionally be causticized before an addition to said cooking step.

3. The method as claimed in claim 2, wherein the alkaline solution being electrolyzed is a white liquor, a portion of said white liquor is added to said process after being electrolyzed and before the chip has the maximum temperature, and a remaining portion of said white liquor is added to the cooking step.

4. The method as claimed in claim 2, wherein the alkaline solution being electrolyzed is a green liquor, a portion of said green liquor is added to said process after being electrolyzed and before the chip has the maximum temperature, and a remaining portion of said green liquor is added to said cooking step after being causticized.

5. The method as claimed in claim 1, wherein the NaOH solution formed at a cathode side is added to the stage among after the chip has the maximum temperature through a bleaching stage which stage is one stage backward of a bleaching stage, contaminated first with a bleaching agent comprising chlorine or an effluent of a bleaching stage comprising a chlorine.

6. The method as claimed in claim 5, further comprising adding a portion of the NaOH solution formed at a cathode side to an oxygen delignification step, and adding a remaining portion of the NaOH solution among the stage after the chip has the maximum temperature through a pulp is blown.

7. The method as claimed in claim 1, wherein said process utilizes a chlorine free bleach, the NaOH solution formed at a cathode side is added among the stage after the chip has the maximum temperature through a final bleaching stage.

8. The method as claimed in claim 7, further comprising adding a portion of the NaOH solution formed at a cathode side to an oxygen delignification step, and adding a remaining portion of the NaOH solution among the stage after the chip has the maximum temperature through a pulp is blown.

9. The method as claimed in claim 1, wherein a bleaching agent in a multi-stage bleaching process for bleaching a pulp optionally subjected to oxygen delignification treatment is $H_2O_2$, said $H_2O_2$ obtained from $H_2$ obtained as a by-product from electrolyzing the alkaline solution containing $Na_2S$.

10. The method as claimed in claim 1, further comprising adding a solution containing a polysulfide and a plurality of quinones to the process before the chip has the maximum temperature, said polysulfide obtained by electrolyzing the alkaline solution containing $Na_2S$ flowing in a kraft pulp process.

* * * * *